US007812211B2

(12) United States Patent
Al Nashef et al.

(10) Patent No.: US 7,812,211 B2
(45) Date of Patent: Oct. 12, 2010

(54) PROCESS FOR THE DESTRUCTION OF HALOGENATED HYDROCARBONS AND THEIR HOMOLOGOUS/ANALOGOUS IN DEEP EUTECTIC SOLVENTS AT AMBIENT CONDITIONS

(75) Inventors: Inas Muen Al Nashef, Riyadh (SA); Saeed M. Al Zahrani, Riyadh (SA)

(73) Assignee: King Saud University, Riyadh (SA)

( * ) Notice: Subject to any disclaimer, the term of this patent is extended or adjusted under 35 U.S.C. 154(b) by 127 days.

(21) Appl. No.: 12/078,002

(22) Filed: Mar. 26, 2008

(65) Prior Publication Data

US 2009/0012345 A1 Jan. 8, 2009

(51) Int. Cl.
*A62D 3/34* (2007.01)

(52) U.S. Cl. ..... 588/316; 588/319

(58) Field of Classification Search ..... 588/316, 588/319

See application file for complete search history.

(56) References Cited

U.S. PATENT DOCUMENTS 6,462,250 B1 * 10/2002 Kuriyama et al. ..... 588/306

* cited by examiner

*Primary Examiner*—Timothy C Vanoy
*Assistant Examiner*—Michelle Hou
(74) *Attorney, Agent, or Firm*—Nixon & Vanderhye P.C.

(57) ABSTRACT

The subject invention provides a potentially economically viable process for the destruction of small to large quantities of halogenated hydrocarbons, their homologous/analogues, and similar hazardous chemicals at ambient conditions using superoxide ion in deep eutectic solvents. The superoxide ion is either electrochemically generated by the reduction of oxygen in deep eutectic solvents or chemically by dissolving Group 1 (alkali metals) or Group 2 (alkaline earth metals) superoxides, e.g. potassium superoxide, in deep eutectic solvents.

14 Claims, No Drawings

PROCESS FOR THE DESTRUCTION OF HALOGENATED HYDROCARBONS AND THEIR HOMOLOGOUS/ANALOGOUS IN DEEP EUTECTIC SOLVENTS AT AMBIENT CONDITIONS

BACKGROUND OF THE INVENTION

1. Field of the Invention

This invention relates to a potentially economically viable process for the destruction of small to large quantities of halogenated hydrocarbons, their homologous/analogues, and similar hazardous chemicals at ambient conditions using the superoxide ion in deep eutectic solvents.

2. Background of the Related Art

The handling, storage, and destruction of hazardous wastes (which includes polychlorinated biphenyls (PCBs), hexachlorohexane (HCB), and most chlorinated organics) is regulated by the Toxic Substances and Control Act (TSCA). Such wastes occur in the public and private sectors. The 1996 Integrated Data Base (IDB) report (DOE/RW Integrated database report 1995: U.S. Spent Nuclear Fuel and Radioactive Waste Inventories, Projections, and Characteristics. DOE/RW-0006, Rev. 12. December 1996) shows over 6.9 million kg of TSCA wastes in the Department of Energy (DOE) complex alone, and more is being generated. In 1995, an additional 543,000 kg of PCB waste was generated throughout the DOE complex, some of which is due to waste remediation and to interim storage of waste awaiting treatment. Although industry is making strides in reducing the usage of chlorinated solvents, a recent survey shows approximately 341,000 kg of trichlorethylene, perchloroethylene, trichloroacetylene, and other chlorinated solvents being used in part by dry cleaning, critical cleaning, paint stripping, and similar operations, Callahan and Green (Hazardous Solvent Source Reduction. 1995, McGraw-Hill: New York). Additional significant volumes of chlorinated hazardous wastes exist in landfills, brownfields, and other contaminated sites. Polyhalogenated aromatic hydrocarbons, which include materials such as PCBs and HCB, represent a major environmental problem. These materials contain components that are animal carcinogens and can cause birth defects, and their continual release into the ecosystem has a deleterious effect on animal life, Kalu and White (J. Electrochem. Soc.; 138: 3656 (1990)). Hexachlorobenzene, which is a byproduct of the poly(chloroethylene) solvent industry, is as environmentally persistent as PCBs and is a human carcinogen, Sugimoto et al. (Environ. Sci. Technol.; 22: 1182 (1988)).

Thermal incineration (oxidation) is the standard method of destroying chlorinated hydrocarbons, and is currently the only legal method of destruction of PCBs. Noyes reviews commercial and near commercial of hazardous waste incineration (Handbook of pollution control processes. 1991. Noyes Publications: Park Ridge, N.J.). Destructive oxidation is done in high-efficiency thermal incinerators or in cement kilns, but the potential for emission of dioxins makes EPA regulations on these operations very strict. Installing and operating direct thermal incineration plants incurs significant public resistance. Another high temperature destruction methods include injection of the waste into a moving bed of molten sodium carbonate salt. Supercritical water oxidation (SCWO) employs high temperature and pressure (>300° C., 20 MPa typically), at which state both oxygen and hydrocarbons become very soluble and destruction rates high, Savage (Chem. Rev.; 99: 603 (1999)) and Anitescu, and Tavlarides (Ind. Eng. Chem. Res.; 39: 583 (2000)). The severe process conditions require high-pressure vessels, and corrosion is a significant limitation. However, commercial installations of SCWO are appearing, and sufficient information for economic evaluation is being generated. Direct chemical oxidation is near ambient process conditions in which strong inorganic oxidants (e.g. sodium peroxydisulfate) in solution are used to destroy low concentration chlorinated waste (DOE/EM-0459 Direct Chemical Oxidation. Innovative Technology Summary Report, prepared for the U.S. Department of Energy, December 1998). Photochemical oxidation is also at the research stage, in this process, photocatalysts such as $TiO_2$ are used to generate active hydroxyl or superoxide radicals in aqueous media, Jones and Watts (J. Env. Eng.: 974 (1997)). Biological destruction of chlorinated pollutants is receiving much attention, especially for in situ remediation; at present the kinetics are very slow, Jiro and Takayanagi (Tetrahedron; 34: 641 (1978)). Sawyer (Oxygen Chemistry, New York: Oxford University Press Inc., 1991) discussed in detail the reactions of $O_2^{\bullet-}$ with halogentaed hydrocarbons. Although the superoxide ion is a powerful nucleophile in aprotic solvents, it does not exhibit such reactivity in water, mainly because of its strong solvation and its rapid hydrolysis and disproportionation. The reactivity of $O_2^{\bullet-}$ with alkyl halides via nucleophilic substitution was first reported in 1970 (Kolarz and Rapak Makromolekulare Chemie; 185: 2511 (1984)) and (Rao and Perlin, Canadian Journal of Chemistry, 59: 333 (1981)). Both 1,1,1-Trichloro-2,2-bis(p-chlorophenyl)ethane (DDT) and methoxychlor are rapidly deprotonated by $HO^-$ in aprotic solvents with subsequent elimination of $Cl^-$ to form dehydrochlorination products; that is, DDT forms 4,4'-dichlorodiphenyldichloroethane1,1-dichloro-chlorobenzene (DDE). The same products are formed in their reaction with $O_2^{\bullet-}$.

Merritt and Sawyer (J. Org. Chem.; 35: 2175 (1970)) studied the kinetics of the reactions of tetraethylammonium superoxide in dimethyl sulfoxide. They showed that stable solutions of tetraethylammonium superoxide could be prepared in aprotic solvents by electrochemical generation.

Sugimoto et al. (Sci. Technol.; 22: 1182 (1988)) reported that polyhalogenated aromatic hydrocarbons (e.g., PCB's and hexachlorobenzene) are rapidly degraded by superoxide ion in dimethylformamide to carbonate and halide ions. The efficient destruction of such materials accomplished via the in situ electrolytic reduction of dioxygen to generate the superoxide ion, which reacts with poly aromatics by nucleophilic substitution. The reaction stoichiometries have been determined by cyclic voltammetric measurements, and the reactant/product profiles have been assayed by capillary gas chromatography and potentiometric titrations.

Analogous complete destruction by superoxide ion occurs for PCB's that contain three or more chlorine atoms per aromatic ring. Another means to the dehalogenation of haloaromatic hydrocarbons is their electrolytic reduction to the parent hydrocarbon in oxygen-free dimethylformamide solutions. Electrochemical studies confirmed that all PCB's can be dehalogenated via anaerobic electrolysis.

The nucleophilic addition of superoxide must take place in an anhydrous environment. The electro-generation of $O_2^{\bullet-}$ from dissolved air represents a much more practical approach for an effective system to destroy PCB's and other halogenated aromatic hydrocarbons. The authors also suggested a reactor for the destruction process. They indicated that a reasonable electrolytic reactor to process such wastes would involve graphite cathodes and anodes with $Me_4NCl$ as the supporting electrolyte in dimethylformamide and the cathode compartment saturated with air or pure $O_2$ at 1 atm. PCB's would be introduced into the cathode compartment and degraded by the reductive activation of the dioxygen. The anode reaction for this reactor involves the oxidation of the chloride ion produced in the cathode compartment. Thus, the overall electrolysis reaction is the equivalent of an electro-stimulated combustion:

$$C_6Cl_6+6O_2 \rightarrow 6CO_2+3Cl_2 \quad (1)$$

When Arochlor 1268 (a commercial PCB fraction that contains a mixture of $Cl_7$, $Cl_8$, $Cl_9$, and $Cl_{10}$ polychlorobiphenyls) is combined with excess $O_2^{\bullet-}$, the entire mixture is degraded. Samples taken during the course of the reaction confirm that the most heavily chlorinated members react first, the initial nucleophilic addition is the rate-determining step, and all components are completely dehalogenated. Tests with other PCB mixtures establish that those components with three or more chlorine atoms per phenyl ring are completely degraded by $O_2^{\bullet-}$ within several hours.

Kalu and White (J. Electrochem. Soc.; 138: 3656 (1990)) studied the effects of current, electrolyte flow, and aprotic media on the extent of degradation of HCB by superoxide ion the electrochemically generated superoxide ion in a flow cell system equipped with a gas fed, porous electrode. The authors found that that the degradation efficiency reported by Sugimoto et al., almost 100% for a batch system was not duplicated for a once-through flow reactor. The disagreement between the results of this work and the batch results of Sugimoto et al. indicated the complexity introduced into the system performance due to the flow effects. Theoretically, the closer the flow approaches zero, the more likely the 100% degradation efficiency will be approached. Their preliminary work showed that in-situ generated superoxide ion in once-through flow reactor, equipped with porous electrode, could be used for the partial degradation of hexachlorobenzene. The anode reaction, thought to be chlorine oxidation, did not interfere with the homogenous chemical reaction between the superoxide ion and the poly-chlorinated substrate. This is because no observation was made of chlorinated products other than $C_6Cl_6$. The authors found that the flow rates or residence time of the electrolyte in the reactor and the applied current density affected the level of substrate destruction achievable. They found that the type of solvent in use also influenced the degradation efficiency. Their experimental results demonstrated that, under the same operating conditions, the percentage degradation achievable was highest in DMF/DMSO solvent.

Although they are proven highly toxic and carcinogenic, chlorinated hydrocarbons (CHC's) are still widely used in the manufacturing of many chemical compounds, such as herbicides, fungicides and pharmaceuticals. CHC's are also applied in dry cleaning processes, in degreasing operations and as organic solvents.

The current method to remove CHC's is thermal incineration at temperatures higher than 1300° C. These high temperatures are required to avoid the formation of dioxins and PCB's. Because of the high incineration temperatures and consequently, the high costs, scientists are forced to look for other but cheaper alternatives that are not harmful to the environment.

A first alternative process is the catalytic oxidation of CHC's at temperatures between 300° C. and 550° C. over supported noble metal catalysts (e.g. Pt, Pd and Au). The essential drawback here is the deactivation of the catalyst by the decomposition products including $Cl_2$ and HCl. Another disadvantage is the formation of volatile oxychlorides, which can condense and block the installation in the colder parts of the reactor. In contrast, it has been stated that supported transition metal oxide catalysts are resistant to these kinds of deactivation. Among these types of oxides $Cr_2O_3$ seems to be the most promising catalyst for the total oxidation of CHC's. Frequently used supports are $Al_2O_3$, $TiO_2$ and $SiO_2$. Other classes of materials are zeolites (e.g. H—Y and H-ZSM-5 zeolites), perovskites (e.g. $LaCoO_3$ and $LaMnO_3$) and pillared clays.

A second alternative for incineration is hydro-dechlorination in which a CHC is transformed in the presence of hydrogen into the corresponding alkane and HCl. Commonly used catalysts are Pd and Pt on various supports. $Ni/SiO_2$ catalysts also seem to possess a high activity. Although this technique has economic and environmental advantages, including the re-use of the reaction products and the elimination of hazardous by-products (e.g. $Cl_2$ and $COCl_2$), it is not used very often. The main reason is the very fast deactivation of the catalyst material. This deactivation is probably due to the interaction between HCl and the catalyst and to coke formation caused by oligomers formed on the acid sites of the catalyst. A third alternative for incineration was provided by Weckhuysen et. al. (J. Phys. Chem. B,; 102: 3773-3778 (1998)). They have studied the destructive adsorption of carbon tetrachloride on alkaline earth metal oxides, more specifically BaO, SrO, CaO and MgO. They concluded that alkaline earth metal oxides are active materials for the destructive adsorption of carbon tetrachloride in the absence of $O_2$. The destruction activity parallels the basicity of the alkaline earth metal oxide. Carbon tetrachloride destruction was accompanied by the formation of chlorides ($BaCl_2$; $SrCl_2$, $CaCl_2$ and $MgCl_2$ in the case of BaO, SrO, CaO and MgO, respectively). They observed that the resulting barium chloride is recyclable by dissolving the solid in water, followed by precipitation and heating in oxygen. The biggest disadvantage of this technique; however, is that it is a stoichiometric and not a catalytic process. This means that, once the metal oxide is converted to the corresponding chloride, the activity of the system falls back to almost undetectable destruction levels.

U.S. Pat. No. 4,561,969 provides a process for the removal of the halogen moiety from halogenated hydrocarbon feedstock. The homogenous process described in this patent depends on the use of sulfuric acid and a lanthanide oxide, the latter being required to break the chlorine ion from the hydrocarbon in order to form a chlorosulfonic acid. The oxides are regenerated by bubbling $O_2$ through the depleted $H_2SO_4$ solution.

U.S. Pat. No. 5,358,65 disclosed compositions suitable for use in degrading and detoxifying polyhalogenated organic compounds comprising an aprotic solvent having dissolved therein (a) an effective amount of hydrogen donor, (b) an effective amount of a compound which produces hydroxide ion or alkoxide ion, and (c) dioxygen, are shown. These reagent compositions may be used to produce superoxide ion in situ for use in a variety of industrial applications to degrade halogenated hydrocarbons, e.g., PCBs. The generation of superoxide ion may be catalyzed by the presence of anthraquinone and derivatives thereof. Reagent compositions containing (a) an effective amount of hydrogen donor, e.g., hydroxylamine, (b) an effective amount of a compound which produces hydroxide ion or alkoxide ion and (c) dioxygen were also disclosed. In preferred methods the dioxygen is bubbled through the solutions to continuously form superoxide ion.

U.S. Pat. No. 6,222,089 disclosed a process for destroying aromatic compounds in an exhaust gas containing also sulfur dioxide, nitrogen oxides and dust, first the dust is removed at a temperature of between room temperature and 150° C. to a residual quantity of not more than 50 $mg/m^3$, the sulfur dioxide is removed to a residual quantity of not more than 1000 $mg/m^3$, the nitrogen oxides are removed to a residual quantity of not more than 300 $mg/m^3$ and the exhaust gas is then subjected to electron irradiation having an energy of 3 to 10 $kWh/1000\ m^3$ exhaust gas.

U.S. Pat. No. 6,127,592 disclosed an in situ hydrous pyrolysis/oxidation process that is useful for in situ degradation of hydrocarbon water and soil contaminants. Fuel hydrocarbons, chlorinated hydrocarbons, polycyclic aromatic hydrocarbons, petroleum distillates and other organic contaminants present in the soil and water are degraded by the process involving hydrous pyrolysis/oxidation into non-toxic products of the degradation. The process uses heat which distributed through soils and water, optionally combined with oxygen and/or hydrocarbon degradation catalysts, and is particularly useful for remediation of solvent, fuel or other industrially contaminated sites.

U.S. Pat. No. 5,986,147 disclosed a method and apparatus for decontamination of soil from contaminates such as polychlorinated biphenyls. The method involves (a) admixing a short chain alcohol and a ethoxylated alcohol to provide a solvent composition, (b) admixing the solvent composition with the contaminated soil to extract the contaminant from the soil into the solvent to form contaminated solvent, (c) separating the soil from the contaminated solvent, (d) washing of the decontaminated soil with water to remove residual solvent from the soil, and (e) distillation of the contaminated solvent to separate the reusable short chain alcohol as a light fraction from a heavy fraction containing the ethoxylated alcohol and the contaminant. The apparatus includes (a) a mixer for mixing the soil and solvent, (b) a centrifuge for separating fines from decanted contaminated solvent, (c) a distillation unit for separating the solvent into a reusable light fraction and a waste heavy fraction, and (d) a water reclamation unit for removing residual solvent from the wash water. The method and apparatus are usable for reclaiming contaminated soils.

U.S. Pat. No. 5,569,809 disclosed a method for detecting and destroying various chlorinated hydrocarbons and unsaturated hydrocarbons in the environment using electrochemical techniques. By concentrating the chlorinated hydrocarbons or unsaturated hydrocarbons in a solvent by liquid-solid or liquid-liquid extraction, and then passing current through the solvent extractant containing the chlorinated hydrocarbons or unsaturated hydrocarbons electrochemically removes chlorine and oxidizes unsaturated hydrocarbons. The potential is measured to correlate to the concentration of the chlorinated hydrocarbon species.

U.S. Pat. No. 5,637,198 disclosed an invention drawn to a volatile organic compound environment effective reduction apparatus comprising a reactor-efficient coronal discharge zone, and at least one pair of high-dielectric coated electrodes. In particular embodiments halogenated volatile organic compounds are reduced and the reaction chamber is chlorine and fluorine resistant.

U.S. Pat. No. 5,564,351 disclosed a process and equipment for pyrolytic decomposition of chlorinated compounds in a molten metal bath in the absence of air to elemental products with recovery of the carbon and chlorine is disclosed.

U.S. Pat. No. 5,393,428 disclosed a process for treating waste water containing chlorinated organic substances, particularly waste water from production of epichlorohydrin which contains more than 10 mg of adsorbable organic halogen compounds per liter, comprising charging the waste water at a pH of 10 to 14 into a reactor and maintaining a temperature of at least 75° C., a pressure of at least 1 bar, and a residence time of at least 0.5 hours in said reactor, thereby partially dechlorinating and/or dehydrochlorinating chlorinated organic compounds contained in the waste water, and thereafter subjecting the waste water to further dechlorination and/or dehydrochlorination treatment in the presence of a hydrogen-containing gas, a hydrogen-releasing compound and/or a catalytically active material; and optionally subjecting the waste water to a biological treatment with the use of microorganisms; and apparatus for carrying out the foregoing process.

U.S. Pat. No. 5,024,949 disclosed a bacterium of the genus *Pseudomonas* which utilizes a branched chain alkyl-substituted aromatic hydrocarbon as its sole carbon and energy source and which capable of substantially complete degradation of trichlorethylene, and methods utilizing the bacterium for the detoxification of trichlorethylene-contaminated material.

U.S. Pat. No. 4,541,907 disclosed a process for decomposing chlorinated hydrocarbon compounds wherein the compounds are heated to an elevated temperature of about 800 to 1200° C. and reacted with alumina and a reactive carbon source. A preferred operating temperature is about 800° C. to 900° C. and preferred carbon sources are activated carbon and coked alumina. The process is particularly useful for disposing of chlorinated organic compounds that are generated in the production of metal chlorides by chlorination of a metal oxide in the presence of carbon.

U.S. Pat. No. 4,423,024 disclosed a method of converting saturated aliphatic chlorinated hydrocarbons to carbon dioxide and hydrogen chloride which comprises contacting a preheated mixture of the hydrocarbon, oxygen and, where necessary, water with a molecular sieve catalyst at temperatures of from about 180 to about 400° C. Simple chlorinated hydrocarbons can thus be completely converted to HCl and $CO_2$ at low temperatures without the production of undesired by-products.

U.S. Pat. No. 5,447,639 disclosed a method for the remediation of aqueous solution contaminated with chlorinated aliphatic hydrocarbons. The chlorinated hydrocarbons are reduced to ethane, ethene, and chloride ion. In-situ reactions can take place in a ditch or screened well. Ex-situ reactions can take place in columns packed with ferrous sulfide.

U.S. Pat. No. 5,994,604 disclosed a method and apparatus for decomposing halogenated hydrocarbons are provided. The halogenated hydrocarbon is mixed with solvating agents and maintained in a predetermined atmosphere and at a predetermined temperature. The mixture is contacted with recyclable reactive material for chemically reacting with the recyclable material to create dehalogenated hydrocarbons and halogenated inorganic compounds. A feature of the invention is that the process enables low temperature destruction of halogenated hydrocarbons.

U.S. Pat. No. 6,096,283 disclosed an integrated system for destruction of organic waste comprises a hydrolysis step at moderate temperature and pressure, followed by direct chemical oxidation using peroxydisulfate. This system can be used to quantitatively destroy volatile or water-insoluble halogenated organic solvents, contaminated soils and sludges, and the organic component of mixed waste. The hydrolysis step results in a substantially single phase of less volatile, more water soluble hydrolysis products, thus enabling the oxidation step to proceed rapidly and with minimal loss of organic substrate in the off-gas.

U.S. Pat. No. 5,575,927 disclosed a method for the reduction halogenated hydrocarbons wherein iron and ferrous sulfide in specific amounts are combined under aerobic or anaerobic conditions to reduce halogenated hydrocarbons in aqueous compositions to non-toxic by-products at near neutral pH. The combination of iron metal and ferrous sulfide in relative amounts gives the unexpected result of a faster reduction rate using iron or ferrous sulfide alone and a controlled pH.

A new class of compounds, ionic liquids has emerged in the last ten years that may become a key ally in meeting the twin challenges of efficient and environmentally benign chemical processing. They have the potential to revolutionize the way we think of and use solvents. The reason is, they act like good organic solvents, dissolving both polar and nonpolar species. In many cases, they have been found to perform better than commonly used solvents. In addition, ionic liquids are non-flammable and non-volatile. The wide and readily accessible range of ionic liquids with corresponding variation in physical properties offers the opportunity to design an ionic liquid solvent system optimized for a particular process.

A key feature of ionic liquids is that their physical and chemical properties can be tailored by judicious selection of cation, anion, and substituents. For example, a choice of anions such as halide ($Cl^-$, $Br^-$, $I^-$) nitrate ($NO_3^-$), acetate ($CH_3CO_2^-$), trifluoroacetate ($CF_3CO_2^-$), triflate ($CF_3SO_3^-$) and bis(trifluoromethylsulfonyl) imide $(CF_3SO_2)_2N^-$) can cause dramatic changes in the properties of ionic liquids. The water solubility of the ionic liquid can be controlled by the nature of the alkyl substituent on the cation. Increasing the length of the alkyl chain tends to decrease water solubility by increasing the hydrophobicity of the cation.

ILs, however, are quite difficult to make, very expensive, and their toxicity has not yet been ascertained. Accordingly, none of these compounds has been registered and this currently limits their wide-scale use. In addition, only a small number of ILs is being produced in commercial quantities.

A deep eutectic solvent (DES) is a type of ionic solvent with special properties composed of a mixture which forms a eutectic with a melting point much lower than either of the individual components. The first generation eutectic solvents were based on mixtures of quaternary ammonium salts with hydrogen donors such as amines and carboxylic acids. The deep eutectic phenomenon was first described in 2003 for a 1 to 2 by mole mixture of choline chloride (2-hydroxyethyltrimethylammonium chloride) and urea. Choline chloride has a melting point of 302° C. and that of urea is 133° C. The eutectic mixture however melts as low as 12° C.

This DES is able to dissolve many metal salts like lithium chloride (solubility 2.5 mol/L) and copper(II) oxide (solubility 0.12 mol/L). In this capacity, these solvents could be applied in metal cleaning for electroplating. Because the solvent is conductive, it also has a potential application in electropolishing. Organic compounds such as benzoic acid (solubility 0.82 mol/L) also have great solubility and this even includes cellulose (filtration paper). Compared to ordinary solvents, eutectic solvents also have a very low VOC and are non-flammable. Other deep eutectic solvents of choline chloride are formed with malonic acid at 0° C., phenol at −40° C. and glycerol at −35° C.

Compared to ionic liquids that share many charactistics but are ionic compounds and not ionic mixtures, deep eutectic solvents are cheaper to make, much less toxic and sometimes biodegradable.

WO 2002 026381 disclosed an invention related to ionic compounds and methods for their preparation. In particular, the invention relates to ionic compounds comprising hydrated metal salts, which are liquid at low temperatures, generally below about 100° C.

WO 02/26701 A2 disclosed a method for the synthesis of DES compounds with a freezing point of up to 100° C. by the reaction of one amine salt (I), such as choline chloride with an organic compound (II) capable of forming a hydrogen bond with the anion of the amine salt, such as urea, wherein the molar ratio of I to II is from 1:1.5 to 1:2.5. The DES compounds are useful as solvents, and electrolytes for example in electroplating, electrowinning, electropolishing, and as catalysts.

WO 00/56700 disclosed a method for the synthesis of DES having a melting point of no more than 60° C., formed by the reaction of a quaternary ammonium compound or a mixture of two or more thereof; with a halide of zinc, tin or iron, or a mixture of two or more thereof.

We were the first to show that a stable superoxide ion can be generated in ILs [AlNashef et al. Ph. D. Dissertation, 2004]. We also showed that hexachlorobenzene could be destroyed by the reaction of the superoxide ion generated in selected ILs.

From what was mentioned above, it is clear that there is a need for a viable method for the destruction of halogenated hydrocarbons that is inexpensive, occurs at low temperature, and most importantly, benign.

DETAILED DESCRIPTION OF THE INVENTION

A deep eutectic solvent is a compound, having a freezing point of up to 100° C. formed by the reaction of at least one amine salt of the formula:

$$R^1R^2R^3R^4N^+X^- \quad (I)$$

with at least one organic compound (II) which is capable of forming a hydrogen bond with $X^{31}$ , wherein $R^1$, $R^2$, $R^3$ and $R^4$ are each independently:-

H, optionally substituted $C_1$, to $C_5$ alkyl, optionally substituted $C_6$ to $C_{,10}$ cycloalkyl, optionally substituted $C_6$ to $C_{12}$ aryl optionally substituted $C_7$ to $C_{12}$ alkaryl, or wherein $R^1$ and $R^2$ taken together represent a $C_4$ to $C_{10}$ optionally substituted alkylene group, wherein the term "optionally substituted" means that the group in question may or may not be substituted with at one or more groups selected from OH, SH, $SR^5$, C1, Br, F, I, $NH_2$, CN, $NO_2$, $COOR^S$, CHO, $COR^5$ and $OR^5$, wherein $R^5$ is a $C_1$ to $C_{,10}$ alkyl or cycloalkyl group;

wherein the organic compound (II) is i) urea, acetamide, thiourea, glyoxylic acid, malonic acid, oxalic acid dihydrate, trifluoroacetic acid, benzoic acid, benzyl alcohol, phenol p-methyl phenol, o-methyl phenol, m-methyl phenol, p-chloro phenol, D-fructose, or vanillin.

ii) aniline or a substituted aniline, a $C_1$-$C_6$ aliphatic acid, a $C_1$-$C_6$ hydroxyaliphatic acid, or a dicarboxylic acid of the formula $HOOC(CH_2)nCOOH$, wherein n is 0 or 1, acetamide, a phenol or a substituted phenol, an alkylene glycol, citric acid, ethylene glycol;

wherein the molar ratio of I to II is from 1:1.5 to 1:2.5

The used halogenated compounds were obtained from different sources, e.g. Sigma-Aldrich, Acros. The stated purity of most of the used substrates was ≧99. The deep eutectic solvents were obtained from Scionix, UK. All chemicals were used without further purification.

Caution: Some of these halogenated compounds are extremely toxic therefore trained and authorized persons should be allowed for this type of work. All the reactions must be performed in an efficient fuming hood and full body protection along with respiratory protection is required during the synthesis and handling of these chemicals. To avoid any accident sufficient amount of decontamination solution should be available at working place.

It was shown in the literature that a stable superoxide ion can be generated in different types of ILs by the electrochemical reduction of oxygen in ILs. [See for example AlNashef et al. Ph. D. dissertation, 2004]. It was also shown that the generated superoxide ion can degrade hexachlorobenzene in the IL 1-butyl-3-methylimidazolium hexafluorophosphate. However, ILs are quite difficult to make, very expensive, and their toxicity has not yet been ascertained. Accordingly, none of these compounds has been registered and this currently limits their wide-scale use. In addition, only a small number of ILs is being produced in commercial quantities.

We found that the superoxide ion can be generated by the reduction of molecular oxygen in DES without the use of a supporting electrolyte. The conductivity of DES is comparable to that of most ILs, e.g. the conductivity of Ethaline is 9 mS/cm. The electrochemically generated superoxide ion can be used to destroy small quantities of chlorinated hydrocarbons, their homologous/analogues, and similar chemicals at ambient conditions in DES. The aforesaid process is explained in the following paragraphs:

Cyclic voltammetry (CV) tests were performed in DES with a stated minimum purity of 99%, which were dried overnight in a vacuum oven at 50° C. The presence of a reduction peak showed that the superoxide ion is produced. The presence of the reverse peak (oxidation of the superoxide ion) indicated that the superoxide ion is stable in the studied DES for the duration of the experiment.

Electrochemistry was performed using an EG&G 263A potentiostat/galvanostat controlled by computer and data acquisition software. The electrode configuration was a glassy carbon working (BAS, 3 mm diameter) and a platinum mesh counter electrode (Aldrich) using Ag/AgCl as a reference electrode (Fisher Scientific).

For the destruction experiments a membrane electrochemical reactor, the cathode and anode compartments were made of Plexiglas with appropriate openings to accommodate the electrodes and to load and unload solutions. Nafion® membrane of different thickness was used as a separator between the cathode and anode compartments. Nafion® membranes were soaked in a boiling 5M NaOH solution for 2-3 h to get rid of $H^+$ and then in boiling distilled water for about 1 h. In some cases the membrane was soaked with DES for 24 h before being used. The anode and cathode compartments were made of Plexiglas. The outside frames of the reactor were made of either Plexiglas for clear visualization of the reactor contents or from metallic alloy with proper grooves to accommodate electrical heating elements. Silicon rubber gaskets were used for leak prevention. A reticulated vitreous carbon (BAS) or Pt mesh (Aldrich) was used as a working electrode. The cathode chamber containing DES (≈20 mL) was purged with argon for 20 min. The catholyte was first pre-electrolyzed until the background current fell to ≈1 mA. Then a weighed amount of the substrate to be destroyed was added to the DES and the solution was stirred with a magnet stirrer for several hours. A sample from the solution was then analyzed using HPLC to be sure that the substrate is totally dissolved in the DES. Oxygen was bubbled through the solution during the electrolysis period. Agitation of the catholyte was achieved by using a magnetic stirrer and through bubbling of oxygen. After electrolysis, diethyl ether was used to extract the products and the remaining reactant from the DES. A sample of the extract was then analyzed with HPLC and GC/MS.

A gas sampling bag had been used for the collection of evolved gaseous products from the reactor. The gaseous products and the sample drawn from the reaction mixture were analyzed for the identification of volatile and non-volatile products monitored by GC/MS. The results were compared with authentic samples. The gaseous contents in the sampling bags were analyzed as such by GC/MS using gas tight syringe, the analysis results showed the formation of chlorine which was matched with spectral library. This gas may be readily contained and prevented from escaping to the atmosphere.

Using HPLC and GC/MS no peaks were detected for chlorinated hydrocarbons or any known degradation product. Calibration of chlorinated hydrocarbons using authentic compounds showed that both GC and HPLC are capable of detecting chlorinated hydrocarbons down to 100 ppm. This means that the destruction of chlorinated hydrocarbons was ≧99.9%. Electro-spray ionization spectrometry confirmed the presence of the bicarbonate ion.

The electrochemical process was relatively slow, in addition, the power needed for this process is relatively high and with the increase of the cost of oil, this may render the process uneconomical for destruction of large quantities of wastes. Fortunately, we found that the superoxide ion can be generated by dissolving Group 1 (alkali metals) or Group 2 (alkaline earth metals) superoxides, e.g. potassium superoxide in DES without the need to use any additional chemicals which are usually used to enhance the solubility of these metal superoxides in aprotic solvents, e.g. crown ethers. In addition, increasing the temperature to about 50° C. increases the solubility of said superoxides drastically. The presence and stability of the superoxide ion in the tested DES were checked using UV-vis spectrophotometer. It is well known that the superoxide ion has a peak at around 250 nm. The process of destruction of halogenated hydrocarbons using chemically generated superoxide ion in DES is described below:

A weighed amount of a chlorinated hydrocarbon was added to about 20 g of DES. The solution was mixed vigorously. After enough time, a sample from the solution was withdrawn and analyzed using HPLC and the resulting peak was compared to the peak of the corresponding chlorinated hydrocarbons in pure organic solvent, e.g. acetone. Then small weighed amounts of the metal superoxide, e.g. potassium superoxide, were added to the solution under vigorous mixing. Samples were then taken and analyzed using HPLC until no peaks for the chlorinated hydrocarbon compound was detected. The solution was then extracted using a proper solvent, e.g. diethyl ether, and the sample was analyzed using GC/MS. No peak was detected for chlorinated hydrocarbons or any known degradation products. Samples from the solution before extraction by ether were dissolved in water and analyzed using electro-spray ionization mass spectrometer. KCl was formed, as confirmed by electro-spray ionization mass spectrometry. Electro-spray ionization mass spectrometry confirmed also the presence of the bicarbonate anion in all cases. During the reaction, samples of the gases evolved from the reaction were collected using gas sampling bags. The samples were then analyzed using GC/MS. No gaseous products, other than water vapor, were detected.

We claim the following:

1. A method for decomposing a halogenated hydrocarbon or a mixture of halogenated hydrocarbons comprising the steps of:

a) mixing the halogenated hydrocarbon or mixture of halogenated hydrocarbons with a deep eutectic solvent or mixture of deep eutectic solvents;

wherein the deep eutectic solvent is a compound, having a freezing point of up to 100° C. formed by the reaction of at least one amine salt of the formula:

$$R^1R^2R^3R^4N^+X^- \quad (I)$$

with at least one organic compound (II) which is capable of forming a hydrogen bond with $X^{31}$ , wherein $R^1$, $R^2$, $R^3$ and $R^4$ are each independently:-

H, optionally substituted $C_1$ to $C_5$ alkyl, optionally substituted $C_6$ to $C_{10}$ cycloalkyl, optionally substituted $C_6$ to $C_{12}$ aryl optionally substituted $C_7$ to $C_{12}$ alkaryl, or wherein $R^1$ and $R^2$ taken together represent a $C_4$ to $C_{10}$ optionally substituted alkylene group, wherein the term "optionally substituted" means that the group in question may or may not be substituted with at one or more groups selected from OH, SH, $SR^5$, Cl, Br, F, I, $NH_2$, CN, $NO_2$, $COOR^S$, CHO, $COR^5$ and $OR^5$, wherein $R^5$ is a $C_1$ to $C_{10}$ alkyl or cycloalkyl group;

wherein the organic compound (II) is i) urea, acetamide, thiourea, glyoxylic acid, malonic acid, oxalic acid dihydrate, trifluoroacetic acid, benzoic acid, benzyl alcohol, phenol p-methyl phenol, o-methyl phenol, m-methyl phenol, p-chloro phenol, D-fructose, or vanillin;

ii) aniline or a substituted aniline, a $C_1$-$C_6$ aliphatic acid, a $C_1$-$C_6$ hydroxyaliphatic acid, or a dicarboxylic acid of the formula $HOOC(CH_2)nCOOH$, wherein n is 0 or 1, acetamide, a phenol or a substituted phenol, an alkylene glycol, citric acid, ethylene glycol;

wherein the molar ratio of I to II is from 1:1.5 to 1:2.5;

b) maintaining the mixture of step a) at a temperature from 10° to 100° C.; and c) the electrochemical generation of the superoxide ion in the mixture by the reduction of oxygen in the mixture wherein the superoxide ion generated in situ will destroy the halogenated hydrocarbons.

2. A method as recited in claim 1, where the superoxide ion is generated by dissolving Group 1 (alkali metals) or Group 2 (alkaline earth metals) superoxides, e.g. potassium superoxide, in deep eutectic solvent or a mixture of deep eutectic solvents.

3. The method as recited in claim 1, wherein the halogenated hydrocarbon is selected from a group consisting of halogenated aromatic compounds, halogenated polyaromatic compounds, halogenated aliphatic compounds, halogenated cyclic compounds, and combinations thereof.

4. The method of claim 1, where the mixture of step a) is at a pressure of no more than about 1 to 3 atmospheres.

5. The method of claim 1, wherein, all of $R^1$, $R^2$, $R^3$ and $R^4$ are not identical.

6. A method as in claim 1, wherein compound II has freezing point of less than 160° C.

7. A method as in claim 1, wherein compound II has a freezing point of 20° C. or less.

8. A method as in claim 1, wherein compound II contains only one type of functional group capable of acting as hydrogen bond donor.

9. A method as in claim 1, wherein the molar ratio of I to II is about 1:2.

10. A method as in claim 1, wherein $R^4$ is a $C_1$ to $C_{10}$ alkyl or a cycloalkyl group, substituted with at least one group selected from OH, Cl, Br, F, I, $NH_2$, CN, $NO_2$, $COOR^5$, $COR^5$, CHO and $OR^5$, wherein $R^5$ is a C1 to C10 alkyl or cycloalkyl group.

11. A method as claimed in claim 1, wherein each of $R^1$, $R^2$, $R^3$, independently is a $C_1$ to $C_5$ alkyl or a cycloalkyl group, and $R^4$ is hydroxyalkyl.

12. A method as claimed in claim 1, wherein each of $R^1$, $R^2$, $R^3$, is methyl, and $R^4$ is hydroxyethyl.

13. A method as claimed in claim 1, wherein $X^-$ is chloride.

14. A method according to claim 1, in which the amine cation is chiral.

* * * * *